United States Patent [19]

Vaccari

[11] 3,969,833

[45] July 20, 1976

[54] ARTICULATION DEVICE BETWEEN VAMP AND LEG, PARTICULARLY FOR SKI BOOTS

[76] Inventor: Franco Vaccari, Via Paleoveneti, 3, Montebelluna (Prov. Treviso), Italy

[22] Filed: July 5, 1974

[21] Appl. No.: 486,030

[30] Foreign Application Priority Data

July 10, 1973 Italy ..... 21832/73[U]

[52] U.S. Cl. ..... 36/117

[51] Int. Cl.[2] ..... A43B

[58] Field of Search..... 36/2.5 R, 2.5 AL

[56] References Cited

UNITED STATES PATENTS 3,570,148 3/1971 Morgan ..... 36/2.5 AL 3,609,887 10/1971 Hickmann et al. ..... 36/2.5 AL 3,824,713 7/1974 Vaccari ..... 36/2.5 AL

*Primary Examiner*—Patrick D. Lawson

*Attorney, Agent, or Firm*—Guido Modiano; Albert Josif

[57] ABSTRACT

An articulation device between vamp and leg, particularly for ski boots. The device comprises a pin with an enlarged head extending from the rear zone of a ski boot vamp and removably coupled with a slot provided in a central portion of the leg. The slot comprises guide means for the relative swing between said vamp and said leg allowing only forward and backward swing of said leg with respect to said vamp.

1 Claim, 5 Drawing Figures

ARTICULATION DEVICE BETWEEN VAMP AND LEG, PARTICULARLY FOR SKI BOOTS

BACKGROUND OF THE INVENTION

This invention relates to an articulation device between vamp and leg, particularly for ski boots.

In plastics ski boots, the articulation between the boot vamp and leg is obtained by a coupling comprising pairs of hinges on opposing sides of the boot.

This design leads to uncomfortable outward swelling of the boot and the presence of hard surfaces inside the boot, precisely at those projecting parts of the foot which because of this are notably more exposed to abrasion or injury.

A further disadvantage of this design is the difficulty of interchanging the vamp and leg.

A further design provides a removable coupling between the vamp and leg, formed by means of a pin with a head projecting from the vamp, which engages with a slot formed in the lower zone of the leg.

Although this design has considerable advantages over previous techniques, in that it enables the legs to be interchanged while keeping the same vamp, it has the disadvantage of not sufficiently limiting the possible lateral swing of the leg with respect to the vamp.

Even though this disadvantage is not serious, it is however particularly felt by those skiers who practice skiing at the competitive level.

SUMMARY OF THE INVENTION

The object of this invention is to provide a new articulation device between vamp and leg which, although providing removable coupling between leg and vamp, completely prevents any possible lateral swing.

A further object of the present invention is to provide a device which is easy to construct and which does not affect the cost of the finished product.

These and further objects which will be more evident hereinafter, are attained by an articulation device between vamp and leg, particularly for ski boots, comprising a pin with an enlarged head extending from the rear zone of the ski boot vamp and removably coupled with a slot provided in a central portion of the leg, comprising guide means for the relative swing between said vamp and said leg.

BRIEF DESCRIPTION OF THE DRAWINGS

Further characteristics and advantages will be more evident from the detailed description of an articulation device illustrated by way of example in the accompanying drawing in which.

DESCRIPTION OF THE PREFERRED EMBODIMENT

Figure 1:
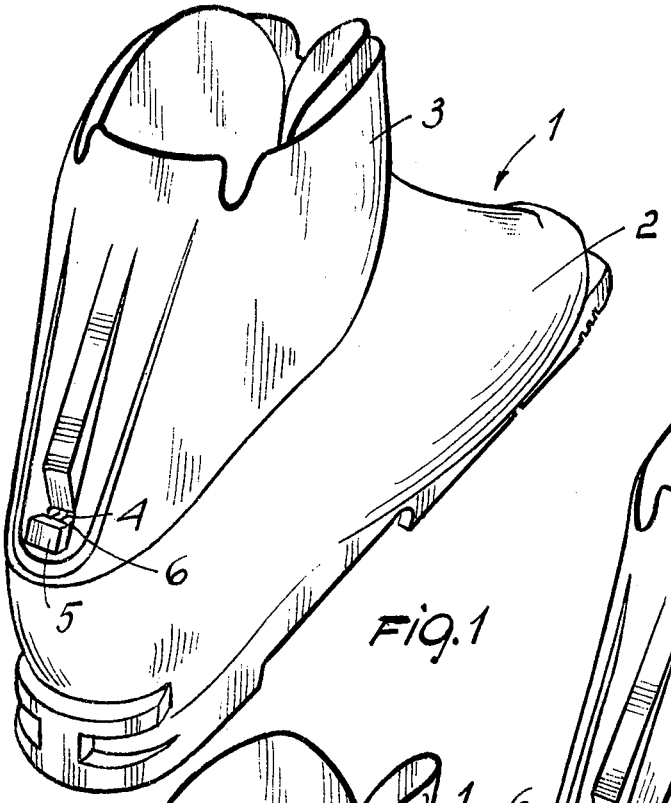
FIG. 1 is a perspective view of a ski boot to which a leg is applied.
Figure 3:
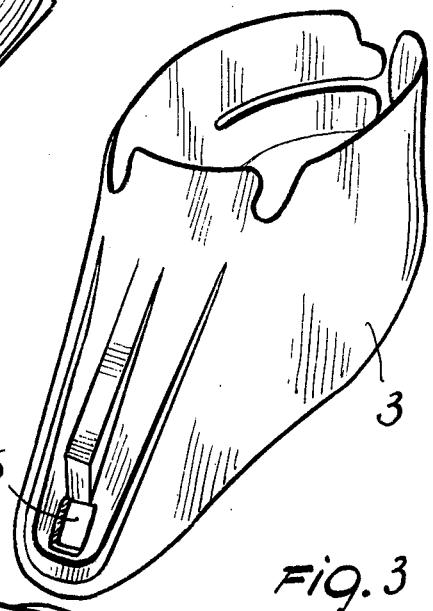
FIG. 3 is a perspective view of a leg.
Figure 2:
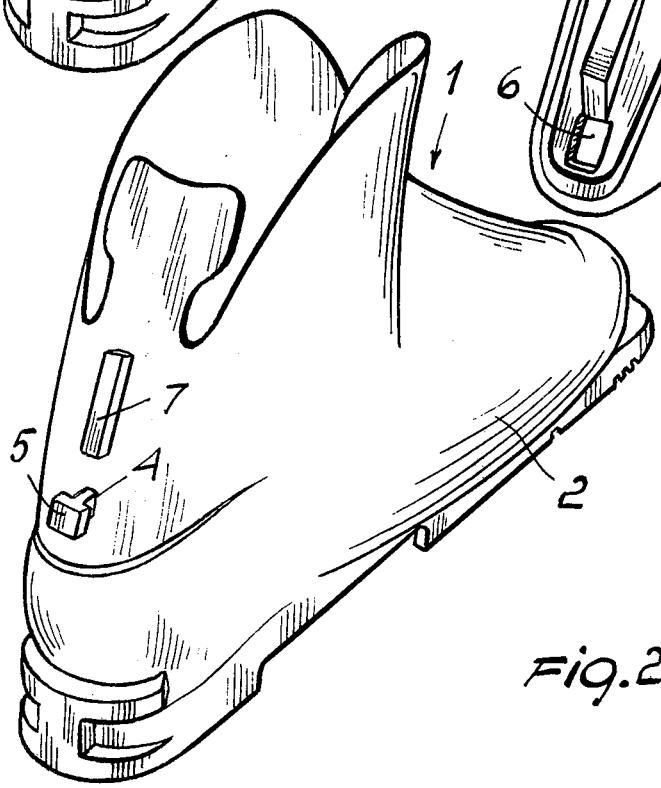
FIG. 2 shows the vamp of a ski boot.
Figure 4:
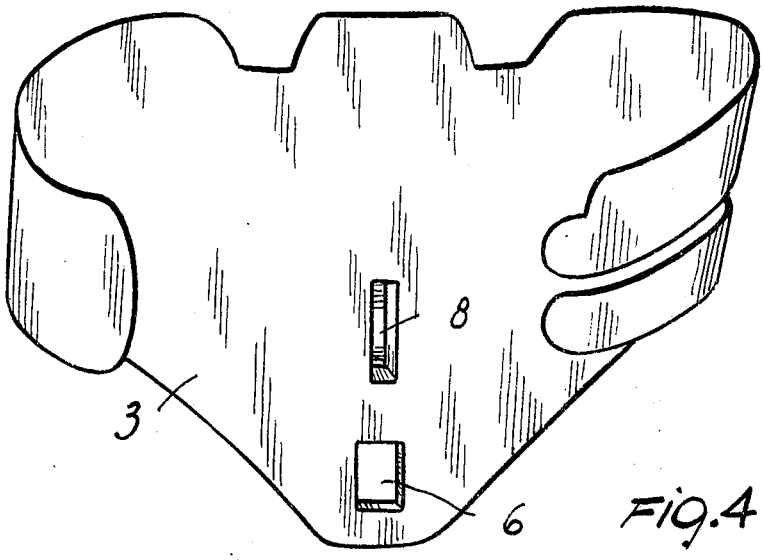
FIG. 4 is a perspective view of a leg seen from its inside.
Figure 5:
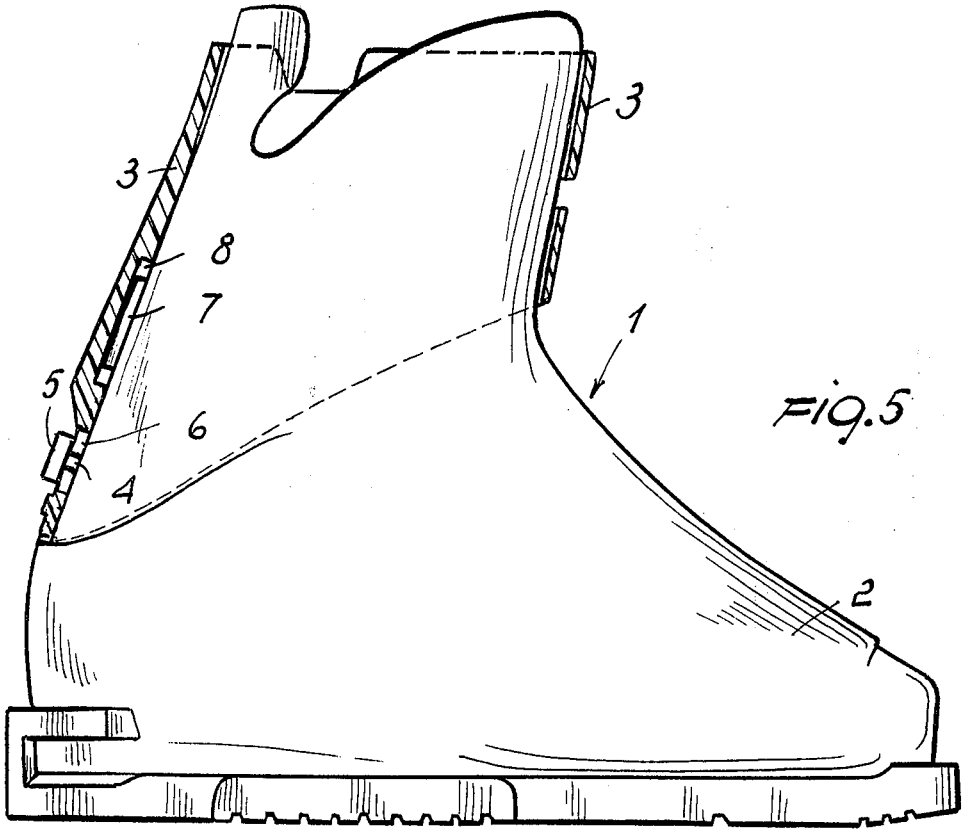
FIG. 5 is a longitudinal sectional view of a vamp with a leg applied.

With reference to the stated figures, the ski boot 1 consists of a vamp to which the relative leg 3 is applied.

The removable coupling between the vamp 2 and leg 3 is obtained by the articulation device according to the invention.

Said articulation device consists of a pin 4 with its relative head 5 projecting rearwards from the vamp 2.

The pin 4 with its relative head 5, may either be formed during the moulding of the vamp 2, in a single piece with it in plastics material, or may be added subsequently to the vamp.

Said head 5 is essentially of horizontally extending elongated shape. The lower rear part of the leg 3 is provided with an aperture 6 of such a size as to allow the head 5 to pass through it, said aperture extending however in a vertical direction.

Consequently, even though the leg is relatively rigid, it can be deformed sufficiently to enable it to be rotated through 90° so as to permit engagement and disengagement between the aperture 6 and the head 5, and hence the coupling or separation of the leg 3 and vamp 2.

The coupling between the pin 4 and aperture 6 connects the vamp to the leg. However if this were the only device used for connection and relative articulation, it would be possible for the leg to swing laterally with respect to the vamp, and for this reason a rib 7 of vertically extending substantially parallelepiped form is provided on the vamp 2 above the pin 4.

Said rib 7 engages in a corresponding cavity 8 formed in the leg and also extending vertically.

The longitudinal dimensions of the cavity 8 are slightly larger than those of the rib 7, to permit a possible small forward and backward swing of the leg with respect to the vamp, without however allowing any possible lateral swing, which would not be welcomed by the skier.

From the description it is evident that the articulation device according to the invention attains all the proposed objects, and in particular it can be seen that it is particularly functional, in that besides connecting the leg 3 to the vamp 2 it has the considerable advantage of allowing replacement of one leg by another, according to the users requirements, extremely easily and rapidly.

It also enables reliable, practical and efficient articulation to be obtained, which totally eliminates any possible lateral swing.

In practice the materials used and the dimensions may be varied according the requirements.

I claim:

1. Articulation device between vamp and leg, particularly for ski boots, comprising a pin with an enlarged head extending from the rear zone of a ski boot vamp and removably coupled with a slot provided in a central portion of the leg, guide means for the relative swing between said vamp and said leg, in which said guide means consist of a vertical rib extending to the rear of said vamp above said pin, said rib being arranged to engage with a corresponding vertically extending cavity formed inside said leg in a position above said aperture, the coupling between said rib and said cavity allowing only forward and backward swing of said leg with respect to said vamp.

* * * * *